US007326028B2

(12) United States Patent
Morando

(10) Patent No.: US 7,326,028 B2
(45) Date of Patent: Feb. 5, 2008

(54) HIGH FLOW/DUAL INDUCER/HIGH EFFICIENCY IMPELLER FOR LIQUID APPLICATIONS INCLUDING MOLTEN METAL

(76) Inventor: Jorge A. Morando, 2277C Wilma Rudolph Blvd., Box 207, Clarksville, TN (US) 37040-5898

( * ) Notice: Subject to any disclaimer, the term of this patent is extended or adjusted under 35 U.S.C. 154(b) by 0 days.

(21) Appl. No.: 11/337,266

(22) Filed: Jan. 23, 2006

(65) Prior Publication Data

US 2006/0245921 A1 Nov. 2, 2006

Related U.S. Application Data

(60) Provisional application No. 60/675,828, filed on Apr. 28, 2005.

(51) Int. Cl.
*F04D 1/12* (2006.01)

(52) U.S. Cl. ..... 415/88; 415/102; 417/900

(58) Field of Classification Search ..... 415/88, 415/102, 200; 416/223 B, 228; 417/423.3
See application file for complete search history.

(56) References Cited

U.S. PATENT DOCUMENTS 3,244,109 A 4/1966 Barske
4,786,230 A 11/1988 Thut
5,586,863 A * 12/1996 Gilbert et al. ..... 415/200
6,303,074 B1 * 10/2001 Cooper ..... 266/235
6,464,458 B2 * 10/2002 Vild et al. ..... 415/200
6,524,066 B2 * 2/2003 Thut ..... 415/200
2006/0180962 A1 * 8/2006 Thut ..... 266/217

OTHER PUBLICATIONS

Val S. Lobanoff and Robert R. Ross, "Centrifugal Pumps Design & Application," Book, 2nd ed., Gulf Publishing Company (Houston, Texas), (Jan. 5, 1985).

* cited by examiner

*Primary Examiner*—Edward K. Look
*Assistant Examiner*—Nathan Wiehe
(74) *Attorney, Agent, or Firm*—Charles W. Chandler; Steve M. Clemmons

(57) ABSTRACT

A centrifugal pump has a pump base with inlet inducer openings that receive molten metal into an impeller chamber. An impeller structure in the impeller chamber passes the metal in a radial direction through an outlet inducer opening into a volute passage for discharge into the pool of metal in which the pump is located.

15 Claims, 8 Drawing Sheets

HIGH FLOW/DUAL INDUCER/HIGH EFFICIENCY IMPELLER FOR LIQUID APPLICATIONS INCLUDING MOLTEN METAL

CROSS-REFERENCE TO RELATED APPLICATION

This application claims domestic priority of Provisional Patent Application filed Apr. 28, 2005, Ser. No. 60,675,828 for HIGH FLOW/DUAL INDUCER/HIGH EFFICIENCY IMPELLER FOR LIQUID APPLICATIONS INCLUDING MOLTEN METAL.

BACKGROUND AND SUMMARY OF THE INVENTION

A typical molten metal facility includes a furnace with a pump for moving molten metal. This invention provides a centrifugal impeller pump that will move more molten metal with a minimum of submergence while retaining a very high overall efficiency. This goal is achieved by accelerating flow into the impeller pump by utilizing the full available pressure head of metal above the pump.

An optimum head is acquired by making my pump very shallow and locating it on the bottom of the well.

A problem with a conventional pump having an excessive height is a tendency to suck dross into the pump, which is undesirable. To compensate, the pump inlet speed is reduced. Reducing the available inlet velocity reduces the pump flow capacity.

In my design, the impeller that moves the metal has a top plate with a radial inlet opening that serves as an inducer. The molten metal passes through the impeller inducer top plate to a horizontal impeller inducer outlet and then into the collector volute in the pump base. The impeller pump achieves three times the molten metal flow rate, without increasing the motor size three times. The reason is that a dual inducer generates higher outlet impeller tip velocity, thus generating higher pressures and flows, consequentially increasing both the mechanical and volumetric efficiencies of the pump.

The top plate of the pump has several inlet inducer openings, typically five to seven, which scoop the molten metal into the rotating pump. Each impeller top plate inlet passage has a chamfered entrance or inducer facing the approaching metal. The chamfered leading edge sucks the molten metal axially down, and the chamfered trailing edge further accelerates the metal downwardly increasing the metal flow velocity.

The reason for the high efficiency of these special, chamfered inducers is that metal flow is a function of both the available inlet head velocity, and the inlet inducer shape. The impeller inlet of my pump has a trapezoidal shape that maximizes the inlet area within the pump impeller available area. The inlet inducer angle matches the rotational velocity and flow axial velocity.

The high recirculation and gas injection efficiency of the metal flow is achieved by making the pump exit velocity as high as necessary to efficiently discharge the metal so as to penetrate the metal pool outside the pump.

The impeller contains an exit inducer as well. Using two inducers is also novel. The impeller exit inducer controls the metal flow exit angle, from the impeller, and the metal flow speed, allowing the designer to vary the pump flow versus pressure characteristics, and to select an optimum volute configuration for the particular application under consideration.

The preferred embodiment of the invention will pump at 300 rpm, 2500 gallons per minute of molten metal out of a pump having a seven and a half-inch tall base. It is so effective that when the pump operates at least 300 rpm, the molten metal shows a charge well penetration of up to 18 feet with overall efficiencies well over 60% with a pump flow capacity of 2400 to 2800 gpm in a pump base of 30"×36"×7.5" in height.

A dual suction impeller pump is also disclosed for delivering 4800/5000 gallons per minute at 300 rpm with a pump base foot print of 30"×36" and only 10.5" in height.

Prior art related to this technology is disclosed in U.S. Pat. No. 3,244,109 issued Apr. 5, 1966 to U. M. W. Barske for "Centrifugal Pumps" and U.S. Pat. No. 4,786,230 issued Nov. 22, 1988 to Bruno H. Thut for "Dual Volute Molten Metal Pump and Selective Outlet Discriminating Means".

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
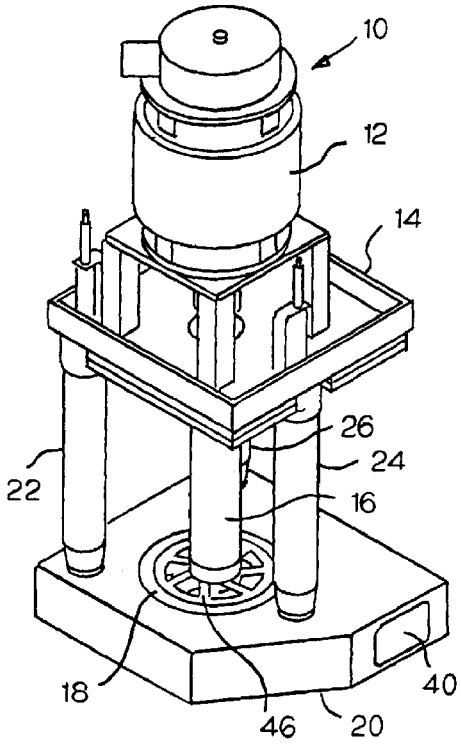
FIG. 1 is a perspective view of a pump illustrating the preferred embodiment of the invention.
Figure 2:
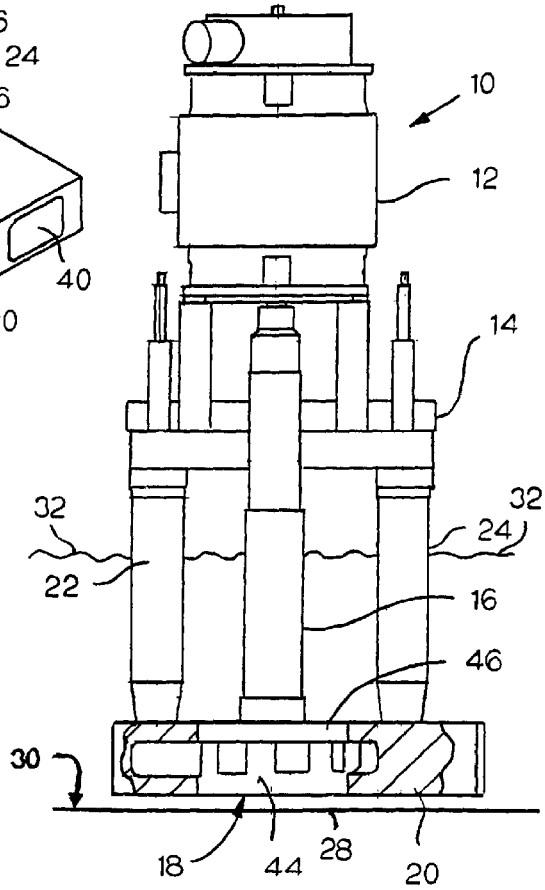
FIG. 2 is a partial sectional view of the pump of FIG. 1.

A preferred centrifugal pump 10, illustrated in FIGS. 1 and 2, comprises a motor 12, supporting structure 14, a vertical shaft 16 and a centrifugal impeller pump 18 mounted in a base 20 formed of either graphite or ceramic.

Supporting structure 14 and motor 12 are mounted on the upper ends of three vertical posts 22, 24 and 26. The three posts have their lower ends attached to base 20. The impeller is inserted in the base and jointly becomes the pump. Shaft 16 connects the motor to impeller 18. The motor and supporting structure are chosen according to the pumping requirements. The supporting structure also accommodates the furnace (well) which holds the molten metal.

Pump base 20 is mounted 1.0" to 2.0" above furnace bottom 28 of a well 30 which contains a quantity of molten metal having a top surface 32. The location of the base is near the bottom of the well to provide a pressure head above the pump intake, permitting the use of a more compact pumping unit and a maximum inlet suction head capacity.

Figure 3:
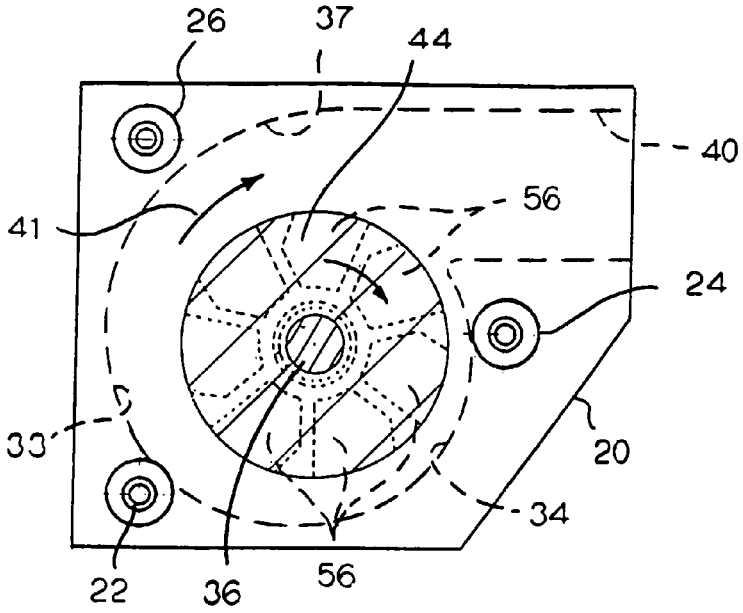
FIG. 3 is a sectional plan view of the base.
Figure 4:
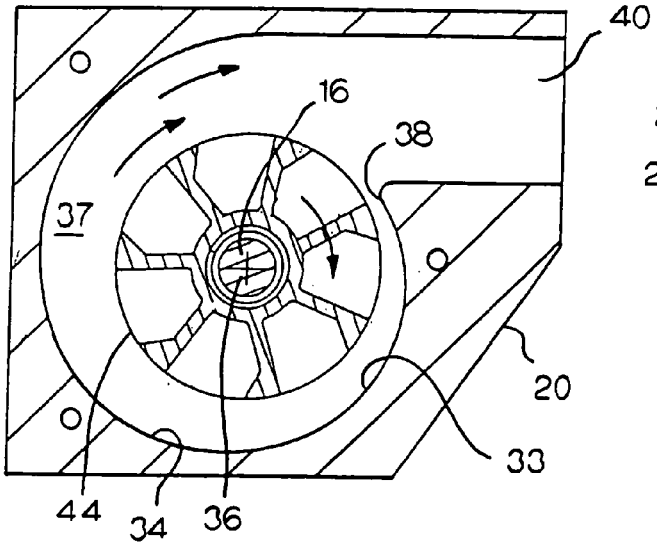
FIG. 4 is a horizontal sectional view of the spiral volute in the base.
Figure 5:
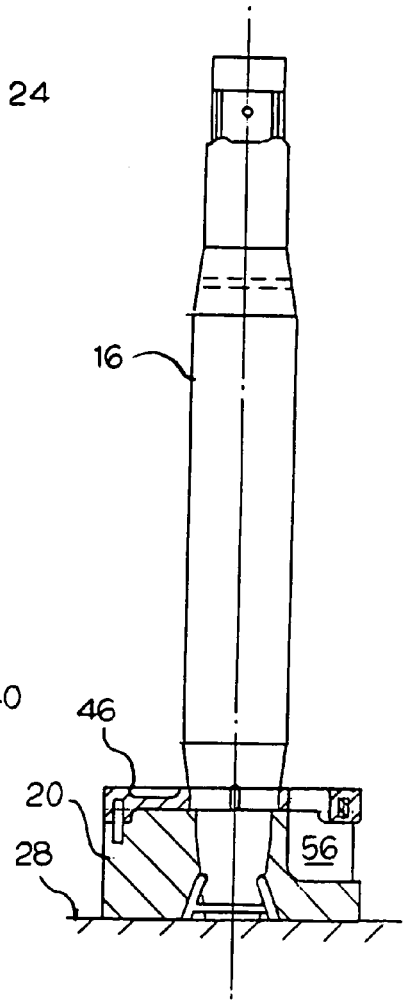
FIG. 5 is a view of the drive shaft.
Figure 6:
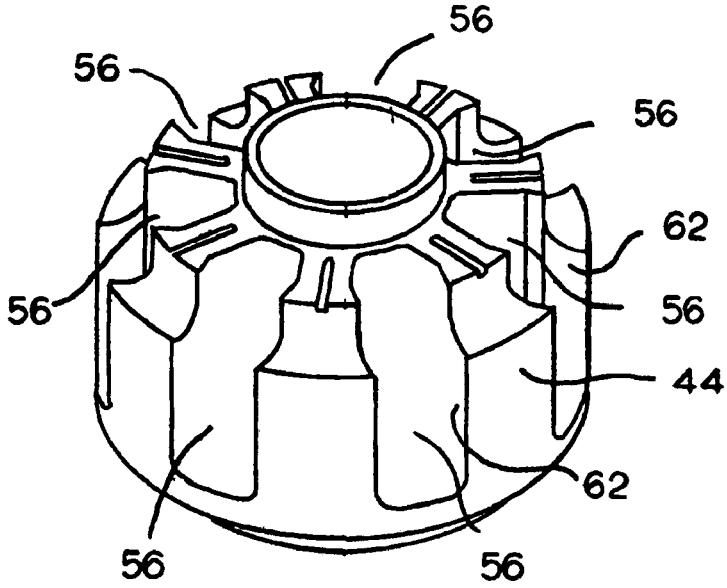
FIG. 6 is a perspective view of the impeller body.

Referring to FIGS. 3 and 4, base 20 has an impeller chamber 33 and a spiral volute wall 34 formed about the axis of rotation 36 of the shaft and defining a spiral volute passage 37. As is well known, a spiral volute passage increases in diameter from cutwater point 38 of the volute to the pump exit opening 40. The liquid flowing through the volute passage exits through a base exit opening 40 shown in FIGS. 1 and 4. The metal moves in the volute passage in a horizontal plane, in the direction of shaft rotation indicated by arrow 41.

The volute inlet at cutwater 38 has a substantial area to permit large solids carried in the metal to pass through the pump without damaging the pump. The clearance as well as the volute shape are established by the well-known design procedures outlined in pump design books such as *Centrifugal Pumps Design & Application* by Val S. Labanoff and Robert R. Ross or *Centrifugal and Axial Flow Pumps* by A J. Stepanoff, $2^{nd}$ Edition 1957.

Centrifugal impeller 18 includes a body 44, and an inducer top plate 46 attached to the body so that the two components rotate as a unit.

Figure 8:
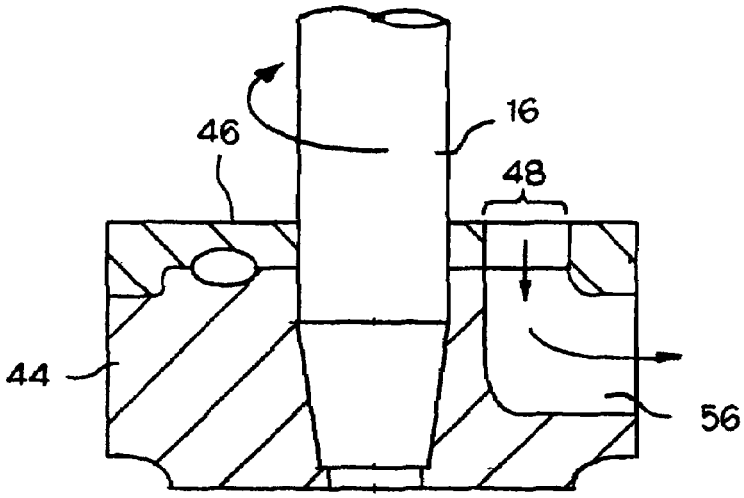
FIG. 8 is a view illustrating the bottom suction passage of the liquid metal through the top plate into the impeller body.
Figure 9:
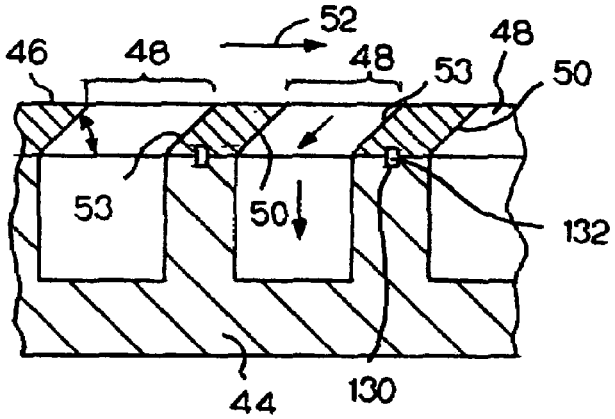
FIG. 9 is a sectional view as seen along lines 9-9 of FIG. 7 to show the bottom suction passage.
Figure 10:
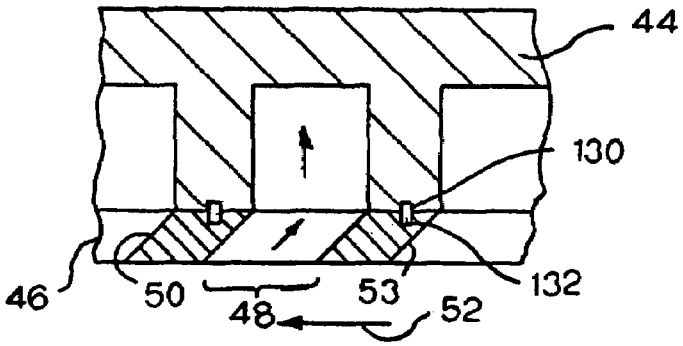
FIG. 10 is a fragmentary sectional view as seen along lines 10-10 of FIG. 7.

Referring to FIGS. 9 and 10, the inducer top plate has the same diameter as the body and includes an annular series of seven inlet openings 48. The trailing wall 50 of each opening 48 is chamfered in a forward direction, as illustrated in FIG. 10, that is in the same direction of rotation 52 toward which the impeller is rotating. Each chamfered trailing wall 50 opposes a parallel flat leading wall surface 53 to form an inducer passage that forces and accelerates the metal downwardly into an elbow-shaped passage 56 that redirects the flow radially outwards, utilizing the centrifugal energy provided by the rotational velocity of the pump shaft as illustrated in FIG. 8. Chamfered walls 50 and 53 in the top plate define an upper inlet inducer for urging the metal downwardly into the impeller body.

Figure 7:
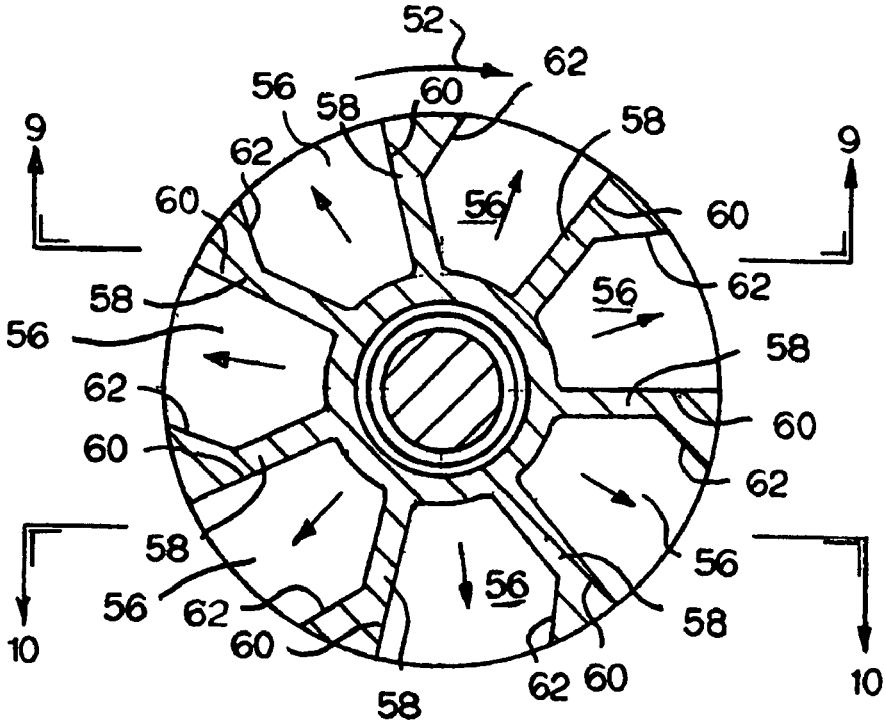
FIG. 7 is a sectional view of the impeller body of FIG. 6.

Referring to FIG. 7, the impeller body has seven vanes 58 mounted in an annular array with an equal angular distance between each pair of vanes. The vanes define the sides of elbow-shaped passages 56. The number of vanes, preferably an odd number, can be three as a minimum with a maximum dictated by the size of the largest contamination solid that can be tolerated by pump cutwater point 38.

The liquid metal passes downwardly and axially through the seven top plate openings 48 and then radially outwardly into the base volute passage 37, as shown in FIG. 4.

The shape of the exit opening of each elbow-shaped passage 56 depends upon the design specifications of the pump. Note in FIG. 7, that each vane has an elongated vertical rib surface 60 that with the flat surface 62 of the next vane defines the exit opening of passage 56, becoming a second inducer or impeller outlet inducer.

The angle of the flat surfaces of each exit opening with respect to the spiral wall of the volute defines the direction of metal flow into the volute passage.

Figure 11:
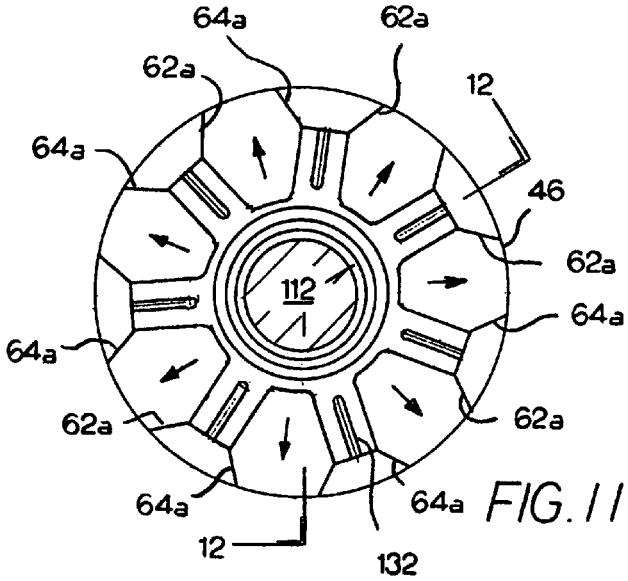
FIG. 11 is a view of a dual suction impeller.

The idea is to control the direction of the exit flow from the impeller, and to optimize its exit velocity by controlling the outlet inducer area. You can then control the characteristics of the pump by defining the direction and velocity of the exiting fluid metal. The direction of the exit flow and its velocity can be changed by changing the angle of surface 62, or by modifying the leading surface 60 of the outlet opening to form a convergent inducer with surfaces 62*a* and 64*a* at the impeller outlet, as shown in FIG. 11.

The height of the pump, in this case, is about seven inches. The height of the base is made as low as possible to prevent sucking undesirable dross into the pump. The lower the pump inlet in the pool of metal, the greater the pressure head of the molten metal. A larger inlet head increases the available acceleration that can be obtained to impart velocity to the metal passing through the impeller inlet. The inlet inducer increases the velocity even further, thus increasing the pump volumetric and overall efficiency.

The design of the pump suits the particular application. For example, the pump may be used to eliminate temperature stratification of the molten metal in the metal furnace. Normally molten metal is cooler at the bottom and warmer adjacent top surface 32. I have improved the efficiency of the process by making the temperature consistent throughout the well by recirculating the metal with a pump whose exit velocity can be modified and optimized for the particular application.

Another application is for moving a large volume of metal at a slow velocity. In this case, the area and the angle of the exit opening are modified to accommodate this flow rate versus pressure performance requirements.

Molten metals, especially aluminum, contain numerous large size contaminants, like refractory, iron, alloy drosses, etc. Another advantage of my invention is that the top inducer plate, besides forcing the liquid downwards in a close guided passage, prevents solid contamination from acquiring significant kinematic centrifugal energy, thus preventing the contaminates from lodging between the rotating impeller blades and the stationary pump housing and bearings.

FIGS. 11-16 illustrate another embodiment of the invention in the form of a double suction impeller with either a single or dual spiral volute pump 100. Pump 100 has a base 102 having an opening 104 for receiving an impeller body 106, a top plate 108, a bottom plate 110 and a shaft 112 into an impeller chamber 113.

Figure 12:
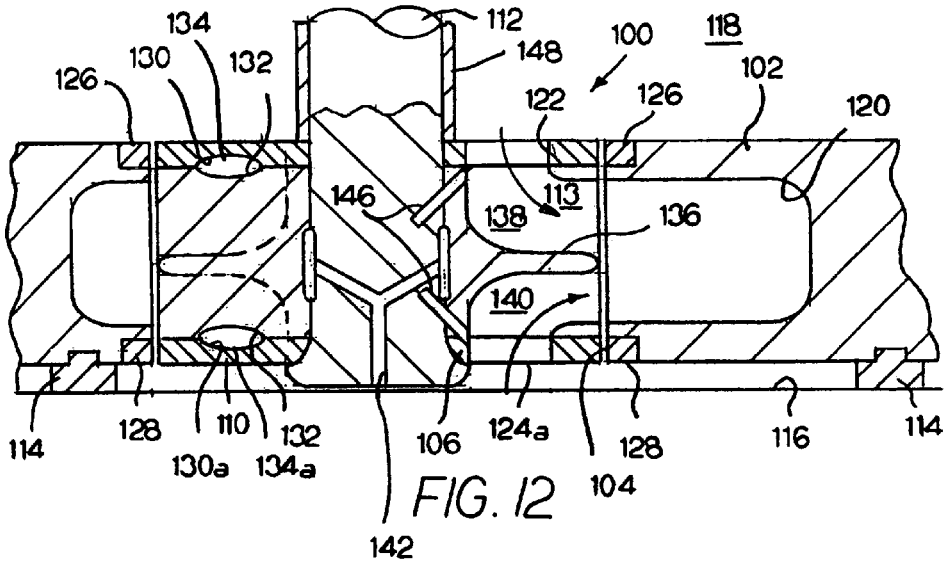
FIG. 12 is a sectional view as seen along lines 12-12 of FIG. 11.

The base is supported in a raised position by feet 114, only two shown, mounted on floor 116 of a well 118, as illustrated in FIG. 12. The base has an internal volute passage 120 having the same configuration as that illustrated in FIG. 4, except that volute passage 120 is higher. Impeller body 106 is attached to shaft 112 so that the impeller body and the upper and lower inducer plates rotate as a unit.

The top inducer plate has an annular series of inlet openings 122, which have the same configuration as the inlet openings of the top plate of the embodiment of FIGS. 1-10. The bottom inducer plate also has inlet openings 124*a*. The bottom inducer plate meets the same design configuration of top plate 108 but in an upside down position.

Referring to FIG. 12, pump base 102 has a pair of annular bearings 126 and 128 which provide a sliding relationship with the impeller top and bottom inducer plates. The impeller body has an upper and lower array of elbow-shaped body passages 138 and 140, similar to passages 56 in FIG. 8.

Figure 13:
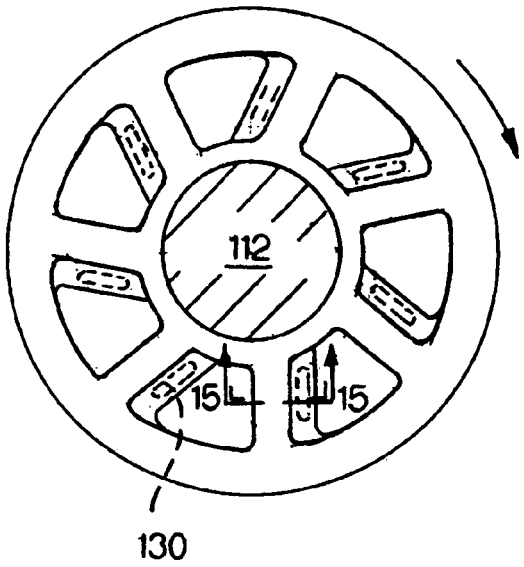
FIG. 13 is a plan view of the top plate of the impeller of a dual suction impeller.
Figure 14:
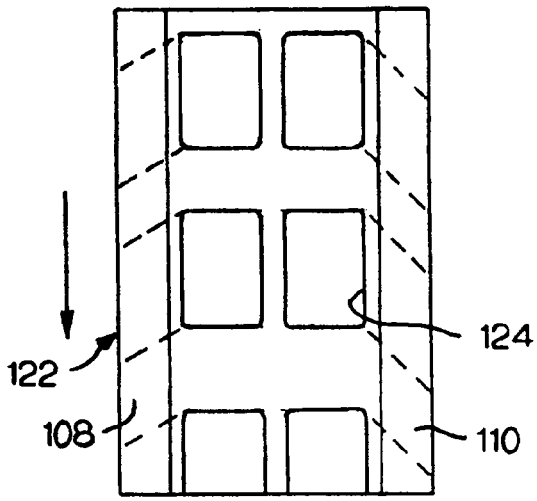
FIG. 14 is a fragmentary view of the exit openings of the dual suction impeller.
Figure 15:
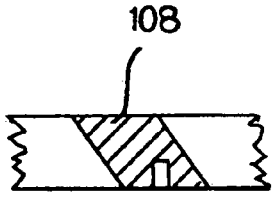
FIG. 15 is a sectional view as seen along lines 15-15 of FIG. 13.
Figure 16:
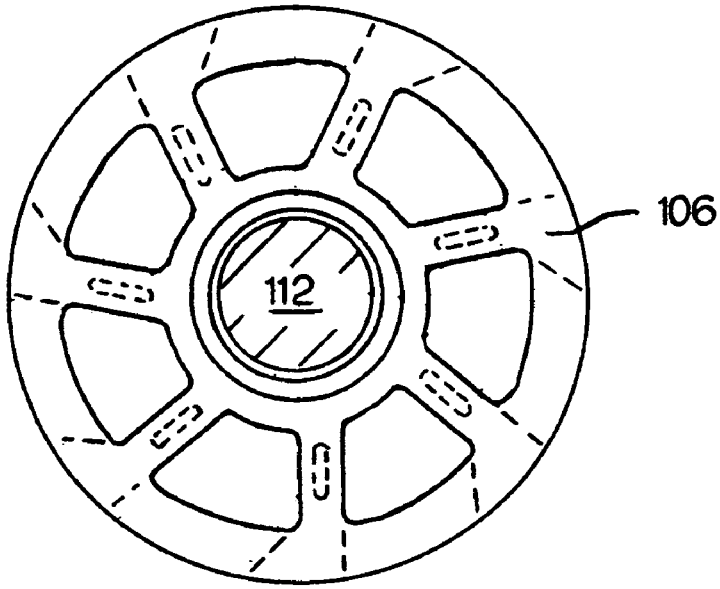
FIG. 16 is a view of the dual suction impeller with the top plate removed.
Figure 17:
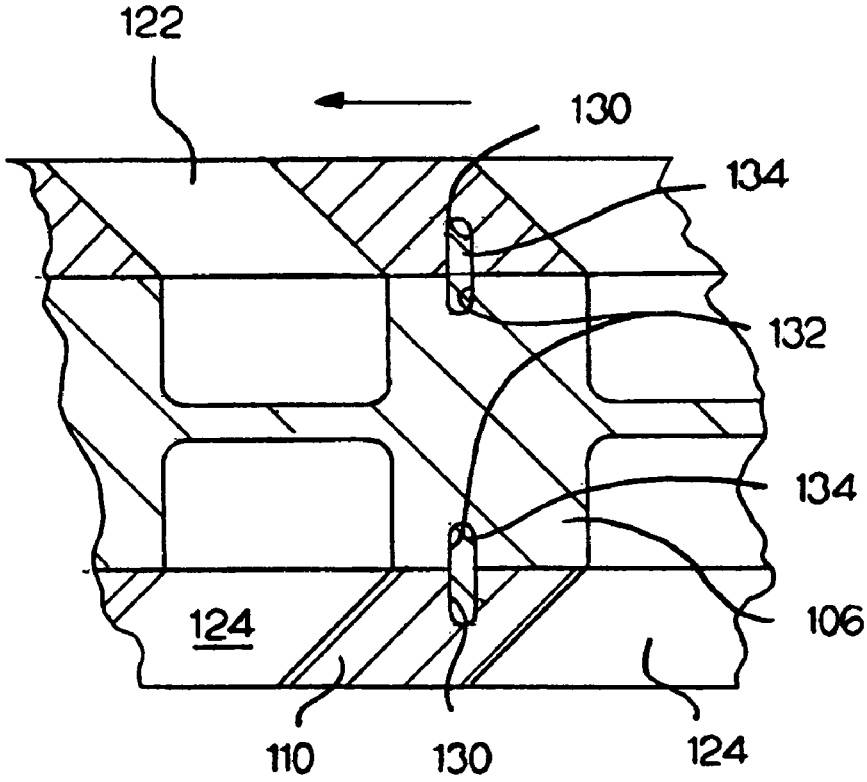
FIG. 17 is a sectional view of the dual suction impeller showing the inlet inducer openings.
Figure 18:
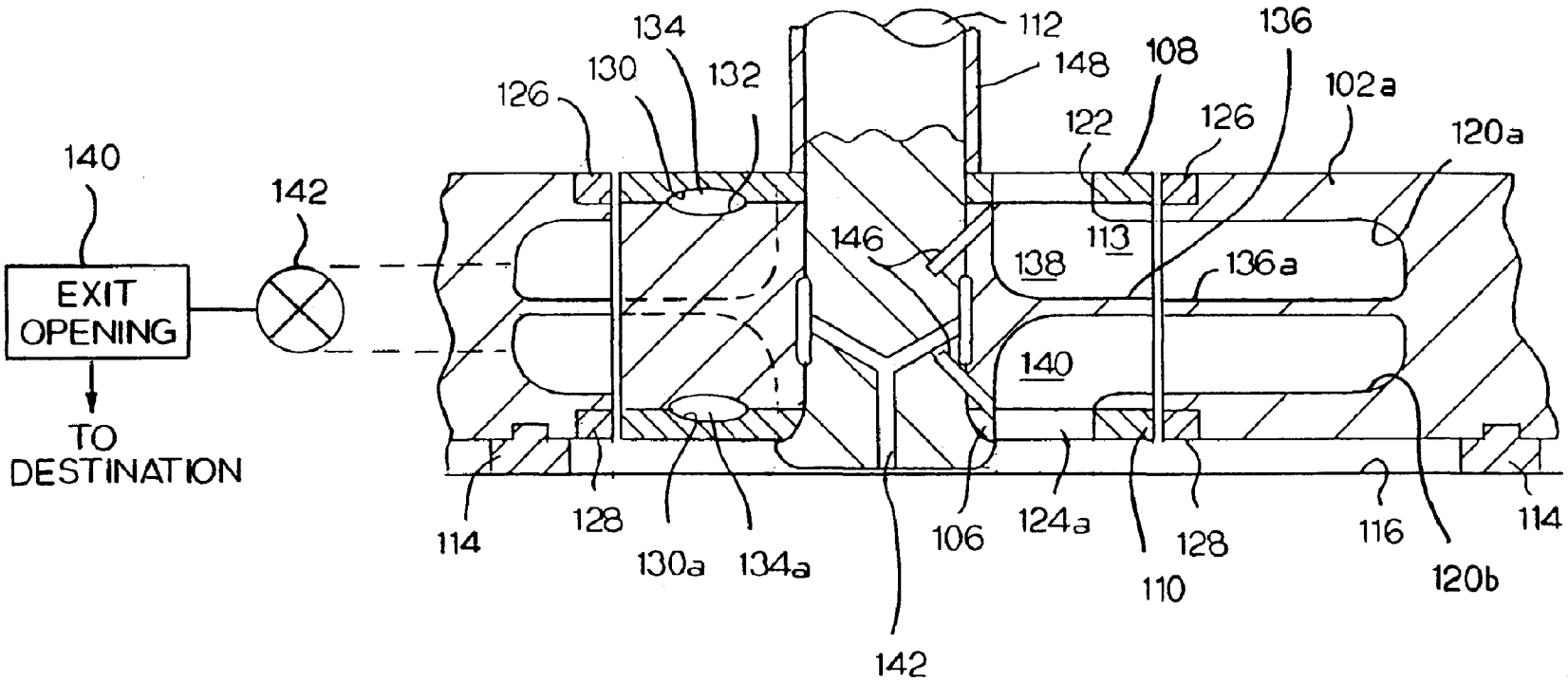
FIG. 18 is a dual volute version of FIG. 12.

Referring to FIGS. 12 and 13, the top plate has a series of slots 130. Seven driving wafers 134 have upper portions received in slots 130 in the upper plate and lower portions in slots 132 in the body.

Similarly, the bottom plate has seven slots 130*a* aligned with seven slots 132 in the underside of the body for receiving driving wafers 134*a*. Thus, as the shaft is rotated, the impeller body rotates with the shaft and both the upper and lower inducer plates as a unit.

Referring to FIG. 12, the impeller body has an annular horizontal lip 136 which defines elbow-shaped openings 138, above the lip, and similar elbow-shaped openings 140 below the lip. As the impeller is rotated, the top plate draws metal downwardly into elbow-shaped openings 138 and the bottom plate draws metal upwardly into elbow-shaped openings 140 aided by the chamfered design of the inlet opening inducers. The two arrays of elbow-shaped openings then discharge their respective quantities of molten metal into the pump base volute passage 120.

Referring to FIG. 12, an axial passage 142 receives an injection of a ceramic cement to aid graphite pins 146 in holding the impeller to the shaft both axially and radially by overcoming the driving torque (radial stresses) and flow velocity forces (axial stresses) although the axial forces are pretty well compensated on a dual suction pump, which is not the case on a single suction pump.

This embodiment of the invention is expected to have a flow rate of about 1600 gpm to 1800 gpm with a 7.5" diameter at 600 rpm, with a base foot print of 23"×23"×6" high, about eight to nine times greater than a standard pump of a comparable size. Alternatively, 4800 to 5000 gpm on a 30"×36"×10.5" high base at 300 rpm with a 14" diameter impeller approximately four times a standard pump.

The shaft carries a ceramic sleeve 148 which is seated on the upper surface of the upper plate. The upper and lower plates are of a ceramic material and the impeller body is of a graphite material. Preferably, the impeller is dynamically balanced up to 1000 rpm.

FIG. 19 illustrates another version of the invention illustrated in FIG. 12. In this case, base 102*a* has a pair of volute-shaped passages 120*a* and 120*b*. Volute passage 120*a* is fluidly connected to elbow-shaped passage 138, and volute passage 120*b* is fluidly connected to elbow-shaped passage 140. Passages 120*a* and 120*b* are separated by an annular horizontal lip 136*a* which is aligned with annular lip 136 of the impeller body. Fluid received through the upper inducer openings passes through the impeller elbow-shaped openings into volute passage 120*a* and then exits through an exit opening 140 to a selected destination. Similarly, the lower volute passage receives through the bottom inlet inducer openings and passes the fluid to exit opening 14. A two-way valve 142 determines which volute passage is connected to the exit opening.

The advantage of such an arrangement is that a single pump can act simultaneously as a recirculation and a metal transferring pump. Recirculation does not have to be stopped as the furnace is emptied thus increasing production. Also, two different flow outlet directions could be provided to increase the area of coverage in the furnace charge well and to accelerate temperature equalization.

Having described my invention, I claim:

1. A centrifugal pump having an impeller with an inducer for pumping fluid, including molten metal, comprising:

a base having an impeller chamber, an exit opening and an internal annular passage fluidly connecting the impeller chamber to the exit opening for discharging a fluid therethrough;

an impeller structure rotatably mounted in the impeller chamber;

a shaft connected to the impeller structure for rotation about a vertical axis;

the impeller structure having an axial inlet inducer opening for receiving fluid from a fluid pool in which the base is disposed, as the shaft is being rotated;

the impeller structure having an internal passage for receiving fluid received through said axial inlet inducer opening and passing the fluid in a radial direction into the internal annular passage in the base; and the axial inlet inducer opening including a trailing wall inclined at an acute angle with respect to the upper surface of the impeller structure and in the direction of rotation of the shaft and a leading planar wall parallel to the trailing wall of the inlet inducer opening to form an acute scooping structure for urging fluid received in the axial inlet inducer opening toward the internal annular passage.

2. The centrifugal pump as defined in claim 1, in which the internal annular passage comprises a spiral volute passage disposed about the axis of rotation of the shaft.

3. The centrifugal pump of claim 1, in which the impeller structure has a top plate with an upper planar surface.

4. The centrifugal pump as defined in claim 3, in which the internal impeller passage has opposed sidewalls reducing the area of the internal passage as the liquid moves toward the base exit opening.

5. A centrifugal pump having an impeller with an inducer, for pumping a fluid, including molten metal, comprising:

a base having an impeller chamber, a base exit opening, and an internal annular passage fluidly connecting the impeller chamber to the base exit opening for discharging a fluid therethrough;

an impeller structure rotatably mounted in the impeller chamber;

a shaft connected to the impeller structure and a power means for rotating the shaft and the impeller structure as a unit about a vertical axis;

the impeller structure having an axial inlet opening for receiving fluid from a fluid pool in which the base is disposed as the shaft is being rotated;

the impeller structure having an internal passage for receiving fluid received through said axial inlet opening and passing the fluid in a radial direction through an impeller exit opening toward a wall in the internal annular passage in the base;

the axial inlet inducer opening including a trailing wall inclined at an acute angle with respect to the upper surface of the impeller structure and in the direction of rotation of the shaft and a leading planar wall parallel to the trailing wall of the inlet inducer opening to form an acute scooping structure for urging fluid toward the internal annular passage; and the impeller exit opening having a wall defining the direction of fluid passing therethrough toward the wall of the internal annular passage.

6. The centrifugal pump of claim 5, in which the impeller exit opening has a pair of spaced walls disposed to deflect fluid received through the internal passage of the impeller structure in a predetermined direction with respect to the path of motion of the fluid passing along said annular passage.

7. The centrifugal pump of claim 6, in which the internal annular passage comprises a spiral volute passage.

8. A centrifugal pump having an impeller with an exit inducer for pumping a fluid, including molten metal, comprising:

a base having an impeller chamber, a base exit opening and an internal annular passage fluidly connecting the impeller chamber to the base exit opening for discharging a fluid therethrough;

an impeller structure rotatably mounted in the impeller chamber;

a shaft connected to the impeller structure for rotation therewith about a vertical axis;

the impeller structure having an axial inlet opening for receiving fluid from a fluid pool in which the base is disposed, as the shaft is being rotated;

the impeller structure having an internal passage for receiving fluid received through said axial inlet opening, and an impeller exit opening for passing the fluid in a radial direction into the annular passage in the base;

the axial inlet inducer opening including a trailing wall inclined at an acute angle with respect to the upper surface of the impeller structure and in the direction of rotation of the shaft and a leading planar wall parallel to the trailing wall of the inlet inducer opening to form an acute scooping structure for urging fluid toward the internal annular passage; and the impeller exit opening being shaped for directing fluid passing therethrough in a predetermined direction toward a wall of the annular passage to define the velocity of the fluid passing through the impeller exit opening.

9. The centrifugal pump of claim 8, in which the impeller exit opening has a pair of spaced planar walls disposed to deflect fluid received through the internal passage of the impeller in a selected predetermined direction with respect to the path of motion of the fluid passage along said annular passage.

10. A centrifugal pump having an impeller for pumping a fluid, including molten metal, comprising:

a base having an impeller chamber, an exit opening and an internal annular passage fluidly connecting the impeller chamber to the exit opening for discharging a fluid therethrough;

an impeller structure rotatably mounted in the impeller chamber;

a shaft connected to the impeller structure for rotation about a vertical axis;

the impeller structure having a first axial inlet opening for receiving fluid in a first direction from a fluid pool in which the base is disposed, as the shaft is being rotated, and a second axial inlet opening for receiving fluid in a second direction from said fluid pool;

the first axial inlet opening including a first trailing wall inclined at an acute angle with respect to the upper surface of the impeller structure and in the direction of rotation of the shaft and a first leading planar wall parallel to the first trailing wall of the first axial inlet opening to form a first acute scooping structure for urging fluid through said impeller structure;

the second axial inlet opening including a second trailing wall inclined at an acute angle with respect to the lower surface of the impeller structure and in the direction of rotation of the shaft and a second leading planar wall parallel to the second trailing wall of the second axial inlet opening to form a second acute scooping structure for urging fluid through said impeller structure; and the impeller structure having internal passage means for passing fluid received through both the first axial inlet opening and the second axial inlet opening in a radial direction toward at least one wall of the internal annular passage to define the velocity of the fluid passing through the impeller exit opening.

11. The centrifugal pump of claim 10 in which the first axial inlet opening receives fluid passing axially downwardly toward the impeller structure, and the second axial inlet opening receives fluid passing axially upwardly toward the impeller structure.

12. The centrifugal pump of claim 10, in which the base has a first spiral volute passage for receiving fluid from the first axial inlet opening, and a second spiral volute passage for receiving fluid from the second axis inlet opening.

13. The centrifugal pump of claim 10, wherein said internal passage means comprises a first annular passage and a second annular passage and in which the base has first and second exit openings, the first exit being fluidly connected to the first annular passage and the second exit opening being fluidly connected to the second annular passage, whereby the pump can deliver fluid to two destinations.

14. A method for making a centrifugal pump for pumping a fluid, comprising the steps of, but not necessarily in this order:

providing a base having an impeller chamber;

fluidly connecting the impeller chamber to a base exit opening for discharging a fluid therethrough;

rotatably mounting an impeller structure in the impeller chamber;

connecting a shaft to the impeller structure for rotation therewith about an axis;

forming an axial inlet inducer opening having parallel leading and trailing planar walls inclined at an acute angle with respect to the upper surface of the impeller and in the direction of rotation of the shaft for receiving fluid from a fluid pool in which the base is disposed as the shaft is being rotated, wherein said axial inlet inducer opening forms an acute scooping structure for urging fluid through said impeller structure;

providing the impeller structure with an internal passage for receiving fluid received through said axial inlet inducer opening and passing the fluid in a radial direction through an impeller exit opening; and providing the impeller exit opening with a shape for directing fluid passing therethrough in a predetermined direction toward a wall of an annular passage, thereby defining the velocity of the fluid moving along the said internal annular passage.

15. A method for making a centrifugal pump having an impeller with an inducer, for pumping a fluid, including molten metal, comprising the steps of, but not necessarily in this order of:

providing a base having an impeller chamber, a base exit opening and an internal annular passage fluidly connecting the impeller chamber to the base exit opening for discharging a fluid therethrough;

rotatably mounting an impeller structure in the impeller chamber;

connecting a shaft to the impeller structure for rotation therewith;

forming an axial inlet inducer opening having parallel leading and trailing planar walls inclined at an acute angle with respect to the upper surface of the impeller and in the direction of rotation of the shaft for receiving fluid from a fluid pool in which the base is disposed as the shaft is being rotated, wherein said axial inlet inducer opening forms an acute scooping structure for urging fluid through said impeller structure;

providing the impeller structure with an internal passage for receiving fluid received through said axial inlet opening and passing the fluid in a radial direction into the annular passage in the base; and providing an outlet inducer opening including a planar trailing wall inclined in the direction of rotation of the shaft to form an acute scooping structure for urging fluid received in the inlet inducer opening toward the internal annular passage in the base.

* * * * *